US009073718B2

(12) United States Patent
Chen

(10) Patent No.: US 9,073,718 B2
(45) Date of Patent: Jul. 7, 2015

(54) AUTOMATIC PAPER FEEDING MECHANISM ADAPTED TO A PAPER ROLL AND THERMAL SUBLIMATION PRINTER THEREWITH

(71) Applicant: HiTi Digital, Inc., New Taipei (TW)

(72) Inventor: Chien-Ju Chen, Keelung (TW)

(73) Assignee: HiTi Digital, Inc., Xindian Dist., New Taipei (TW)

( * ) Notice: Subject to any disclaimer, the term of this patent is extended or adjusted under 35 U.S.C. 154(b) by 354 days.

(21) Appl. No.: 13/692,998

(22) Filed: Dec. 3, 2012

(65) Prior Publication Data

US 2013/0161369 A1 Jun. 27, 2013

(30) Foreign Application Priority Data

Dec. 22, 2011 (TW) ..... 100148076 A

(51) Int. Cl.

| | |
|---|---|
| ***B41J 15/04*** | (2006.01) |
| ***B65H 19/10*** | (2006.01) |
| ***B65H 20/00*** | (2006.01) |
| ***B41J 2/32*** | (2006.01) |
| ***B65H 20/02*** | (2006.01) |
| ***B65H 23/04*** | (2006.01) |
| *B41M 5/382* | (2006.01) |

(52) U.S. Cl.

CPC ..... *B65H 20/00* (2013.01); *B65H 19/105* (2013.01); *B65H 2301/415185* (2013.01); *B41M 5/38214* (2013.01); *B41J 2/32* (2013.01); *B41J 15/042* (2013.01); *B41J 15/046* (2013.01); *B65H 20/02* (2013.01); *B65H 23/04* (2013.01); *B65H 2404/143* (2013.01); *B65H 2404/7414* (2013.01); *B65H 2801/12* (2013.01)

(58) Field of Classification Search

CPC ..... B41J 15/04; B41J 15/042; B41J 15/046; B65H 201/415185; B65H 2404/7414; B65H 19/105

See application file for complete search history.

(56) References Cited

U.S. PATENT DOCUMENTS

| | | | | | |
|---|---|---|---|---|---|
| 3,461,703 | A * | 8/1969 | Ranney | ..... | 72/183 |
| 3,834,204 | A * | 9/1974 | Ihle | ..... | 72/183 |
| 2002/0154205 | A1 * | 10/2002 | Kaya | ..... | 347/177 |
| 2010/0051665 | A1 | 3/2010 | Nakayama | | |
| 2012/0026265 | A1 * | 2/2012 | Kawashima | ..... | 347/104 |

FOREIGN PATENT DOCUMENTS

| | | | | | |
|---|---|---|---|---|---|
| CN | 101910006 | A | | 12/2010 | |
| CN | 102241203 | A | | 11/2011 | |
| JP | S58189659 | | | 12/1983 | |
| JP | 11049409 | A | * | 2/1999 | ..... B65H 19/10 |
| JP | 2005060017 | A | * | 3/2005 | ..... B65H 19/10 |
| JP | 2011037557 | A | * | 2/2011 | ..... B65H 19/10 |
| KR | 1020060078423 | | | 7/2006 | |

* cited by examiner

*Primary Examiner* — Daniel J Colilla

(74) *Attorney, Agent, or Firm* — Winston Hsu; Scott Margo

(57) ABSTRACT

An automatic paper feeding mechanism adapted to a paper roll is disclosed. The automatic paper feeding mechanism includes a first pivotal member, a paper pressing module, a driving member and a paper guiding module. The paper pressing module is pivoted to the first pivotal member for pressing the paper roll. The driving member is for driving the paper pressing module, such that the paper pressing module respectively presses the paper roll in a first position and a second position. The paper guiding module is connected to the paper pressing module. The paper guiding module is driven by the paper pressing module to move from a first guiding position to a second guiding position when the paper pressing module is moved from the first position to the second position, so as to adjust a gap between the paper guiding module and the paper roll.

15 Claims, 7 Drawing Sheets

AUTOMATIC PAPER FEEDING MECHANISM ADAPTED TO A PAPER ROLL AND THERMAL SUBLIMATION PRINTER THEREWITH

BACKGROUND OF THE INVENTION

1. Field of the Invention

The present invention relates to an automatic paper feeding mechanism and a thermal sublimation printer therewith, and more particularly, to an automatic paper feeding mechanism adapted to a paper roll and a thermal sublimation printer therewith.

2. Description of the Prior Art

Generally speaking, when a paper roll is installed into a conventional thermal sublimation printer, a front edge of a printing medium on the paper roll needs to be manually installed into a zone where a feeding roller conveys the printing medium. In such a manner, the feeding roller of the thermal sublimation printer is capable of conveying the printing medium to a thermal print head module for performing following thermal printing operations for the printing medium. However, a surface of the printing medium might be polluted due to careless touch of users during the above-mentioned installation process. In addition, since the user might not be sufficiently familiar with the installation operations, it often results in improper installation of the printing medium, such as skew, folding of the printing medium and so on during the above-mentioned installation process and generates issues of feeding failure accordingly.

SUMMARY OF THE INVENTION

The present invention provides an automatic paper feeding mechanism adapted to a paper roll and a thermal sublimation printer therewith for solving above drawbacks.

According to the claimed invention, an automatic paper feeding mechanism adapted to a paper roll includes a first pivotal member, a paper pressing module, a driving member and a paper guiding module. The paper pressing module is pivoted to the first pivotal member for pressing the paper roll. The driving member is for driving the paper pressing module, such that the paper pressing module respectively presses the paper roll in a first position and a second position. The paper guiding module is connected to the paper pressing module. The paper guiding module is driven by the paper pressing module to move from a first guiding position to a second guiding position when the paper pressing module is moved from the first position to the second position, so as to adjust a gap between the paper guiding module and the paper roll.

According to the claimed invention, the paper guiding module includes a second pivotal member, a first paper guiding member and a second paper guiding member. The second paper guiding member is pivoted to the second pivotal member and connected to the paper pressing module and the first paper guiding member. The second paper guiding member is driven by the paper pressing module for moving the first paper guiding member from the first guiding position to the second guiding position when the paper pressing module is moved from the first position to the second position, so as to adjust the gap between the first paper guiding member and the paper roll.

According to the claimed invention, the paper pressing module includes a sliding member. A slot is formed on the second paper guiding member. The sliding member is slidably installed inside the slot, such that the second paper guiding member slides and rotates relative to the paper pressing module. The first paper guiding member includes a main body, an adjustment member and a recovery member. The adjustment member is pivoted to the main body and connected to the second paper guiding member. The recovery member is for driving the adjustment member to rotate relative to the main body when the paper guiding module is driven by the paper pressing module.

According to the claimed invention, the paper guiding module further includes a connecting member disposed on the adjustment member for connecting the adjustment member with the second paper guiding member.

According to the claimed invention, the recovery member is a torsion spring.

According to the claimed invention, the paper pressing module includes a first idle roller for rollably pressing a printing medium on the paper roll. The automatic paper feeding mechanism further includes a sensor and a transmission shaft. The sensor is disposed on the main body for sensing the printing medium on the paper roll. The transmission shaft is for driving the paper roll to rotate in a first direction when the sensor does not sense the printing medium, and further for driving the paper roll to rotate in a second direction opposite to the first direction when the sensor senses the printing medium.

According to the claimed invention, the automatic paper feeding mechanism further includes a guiding member and a second idle roller. The guiding member is pivoted to the second paper guiding member and abuts against the paper roll. The guiding member is for guiding the printing medium to enter the second paper guiding member when the paper roll rotates in the second direction. The second idle roller is for rollably pressing the paper roll. The second idle roller is for keeping the paper roll firmly shaped cooperatively with the first idle roller when the paper roll rotates in the second direction.

According to the claimed invention, the driving member is a torsion spring.

According to the claimed invention, a thermal sublimation printer includes a paper roll, a feeding roller and an automatic paper feeding mechanism. The feeding roller is for moving a printing medium on the paper roll. The automatic paper feeding mechanism is for conveying the printing medium on the paper roll to the feeding roller. The automatic paper feeding mechanism includes a first pivotal member, a paper pressing module, a driving member and a paper guiding module. The paper pressing module is pivoted to the first pivotal member for pressing the paper roll. The driving member is for driving the paper pressing module, such that the paper pressing module respectively presses the paper roll in a first position and a second position. The paper guiding module is connected to the paper pressing module. The paper guiding module is driven by the paper pressing module to move from a first guiding position to a second guiding position when the paper pressing module is moved from the first position to the second position, so as to adjust a gap between the paper guiding module and the paper roll.

According to the claimed invention, a transmission mechanism is for driving the transmission shaft to rotate.

In summary, the automatic paper feeding mechanism of the present invention utilizes the transmission mechanism, the transmission shaft and the sensor to automatically guide the printing medium on the paper roll into the feeding roller, such that the printing medium on the paper roll is installed into the feeding roller without manual operations. In such a manner, the automatic paper feeding mechanism of the present invention can prevent a surface of the printing medium from being polluted due to careless touch of users during the above-mentioned installation process, and further prevent issues of feeding failure generated by improper installation of the printing medium. In addition, by connection among the paper pressing module, the second paper guiding member and the first paper guiding member, the automatic paper feeding mechanism of the present invention can be used for adjusting the gap between the paper guiding module and the paper roll. For example, the automatic paper feeding mechanism can be used for adjusting the gap between the paper guiding module and the paper roll according to the paper rolls with different sizes or according to a thickness of the paper roll in use, such that the printing medium on the paper roll is capable of being guided into the feeding roller by the paper guiding module precisely. Accordingly, it can prevent the printing medium from damages, such as skew, folding of the printing medium and so on, when the feeding roller moves the printing medium to the thermal print head module.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
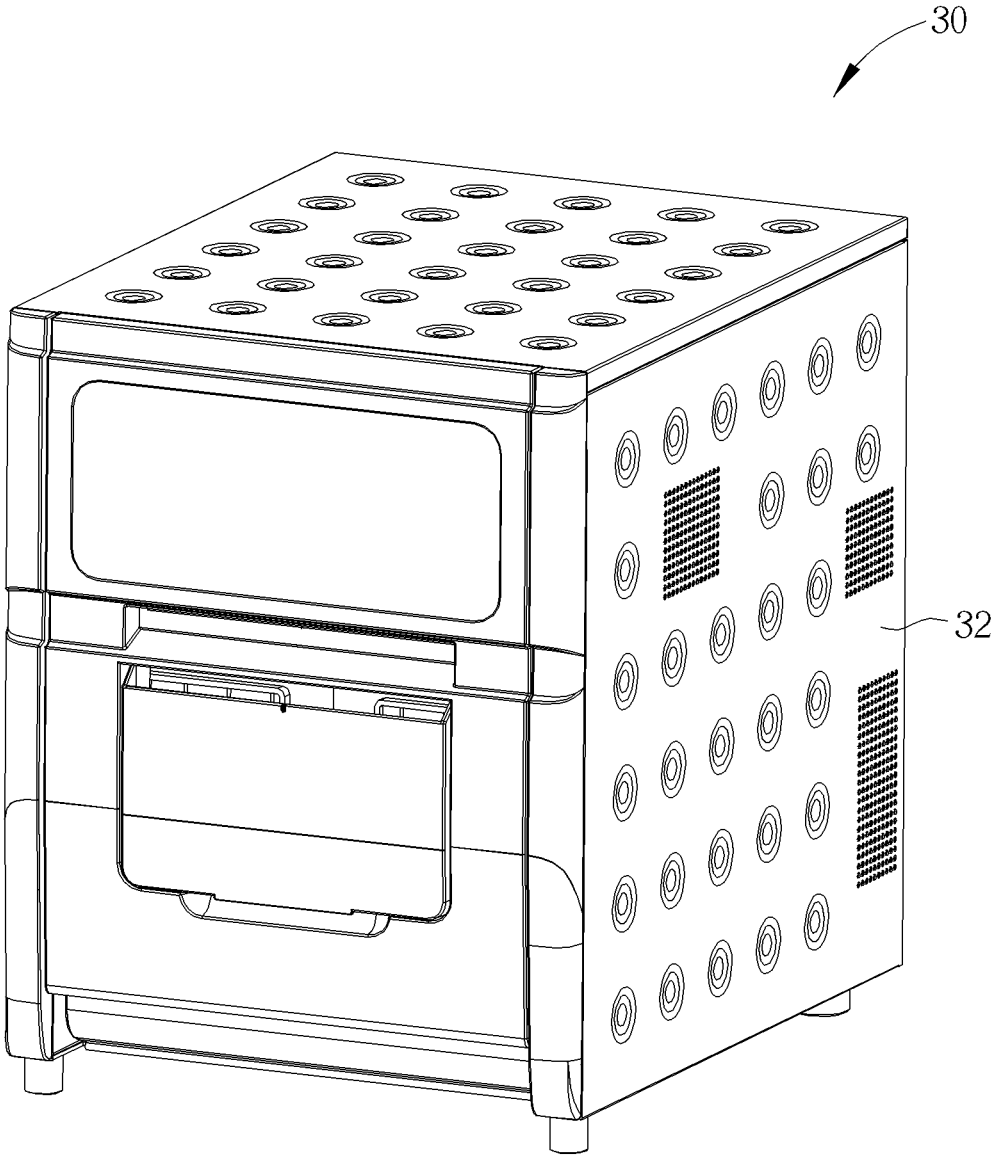
FIG. 1 is a schematic diagram of a thermal sublimation printer according to a preferred embodiment of the present invention.
Figure 2:
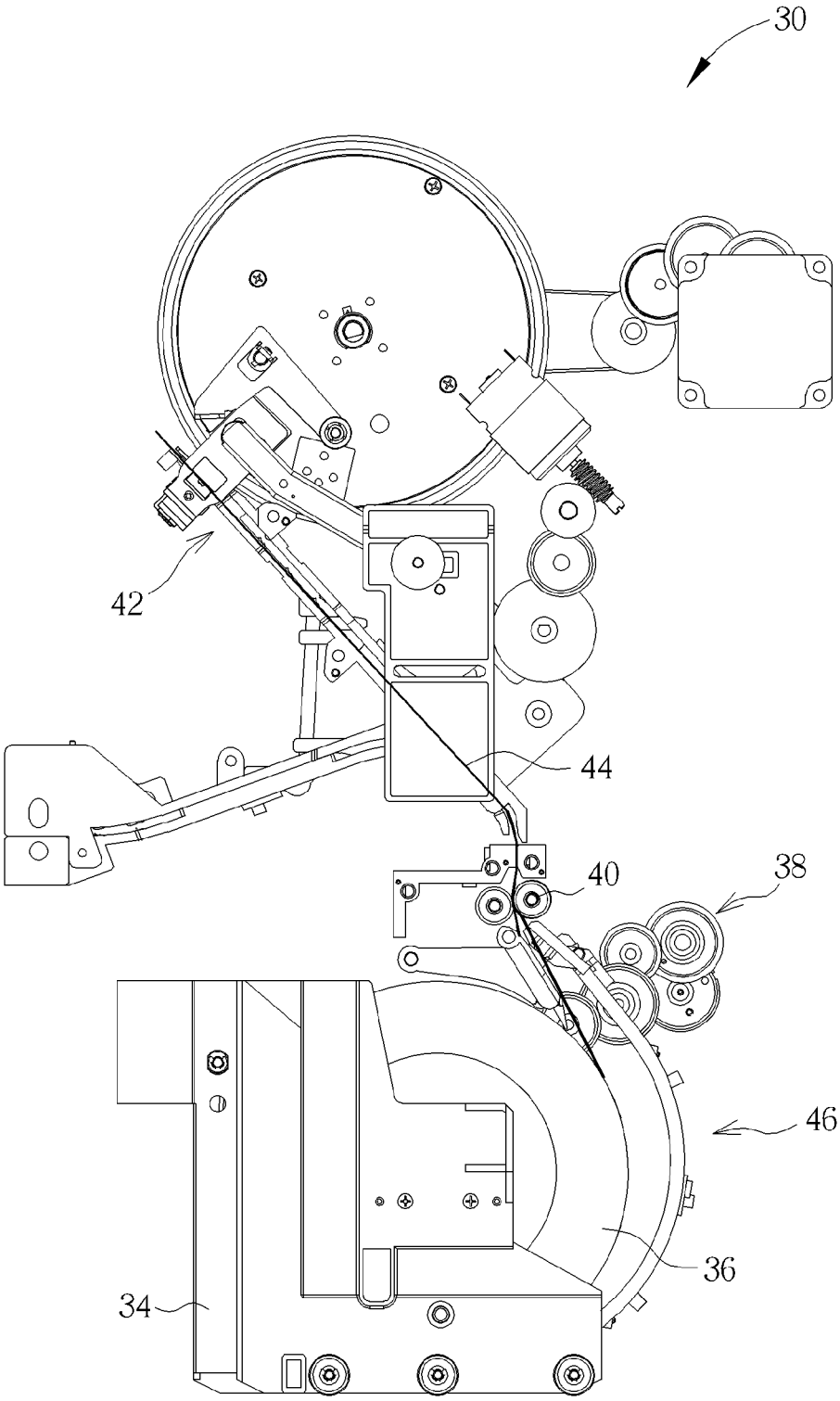
FIG. 2 is an internal diagram of the thermal sublimation printer according to the preferred embodiment of the present invention.

Please refer to FIG. 1 and FIG. 2. FIG. 1 is a schematic diagram of a thermal sublimation printer 30 according to a preferred embodiment of the present invention. FIG. 2 is an internal diagram of the thermal sublimation printer 30 according to the preferred embodiment of the present invention. As shown in FIG. 1 and FIG. 2, the thermal sublimation printer 30 includes a casing 32 and a holding member 34. The holding member 34 is disposed on a bottom of the casing 32 for holding a paper roll 36. Furthermore, the thermal sublimation printer 30 further includes a conveying mechanism 38, a feeding roller 40 and a thermal print head module 42. The conveying mechanism 38 is used for driving the paper roll 36, such that a printing medium 44 on the paper roll 36 is conveyed to the feeding roller 40. Furthermore, the feeding roller 40 is used for moving the printing medium 44 on the paper roll 36 to the thermal print head module 42 stably. Accordingly, the thermal print head module 42 can perform following thermal printing operations, so as to transfer an image onto the printing medium 44.

Furthermore, the thermal sublimation printer 30 further includes an automatic paper feeding mechanism 46. The automatic paper feeding mechanism 46 cooperates with the conveying mechanism 38 for conveying the printing medium 44 on the paper roll 36 to the feeding roller 40. When the paper roll 36 is installed, the printing medium 44 on the paper roll 36 can be automatically guided into the feeding roller 40, such that the printing medium 44 on the paper roll 36 is installed into the feeding roller 40 without manual operations. In such a manner, the automatic paper feeding mechanism 46 can prevent a surface of the printing medium 44 from being polluted due to careless touch of users during installation process, and further prevent issues of feeding failure, such as skew, folding of the printing medium 44 and so on, generated by improper installation of the printing medium 44.

Figure 3:
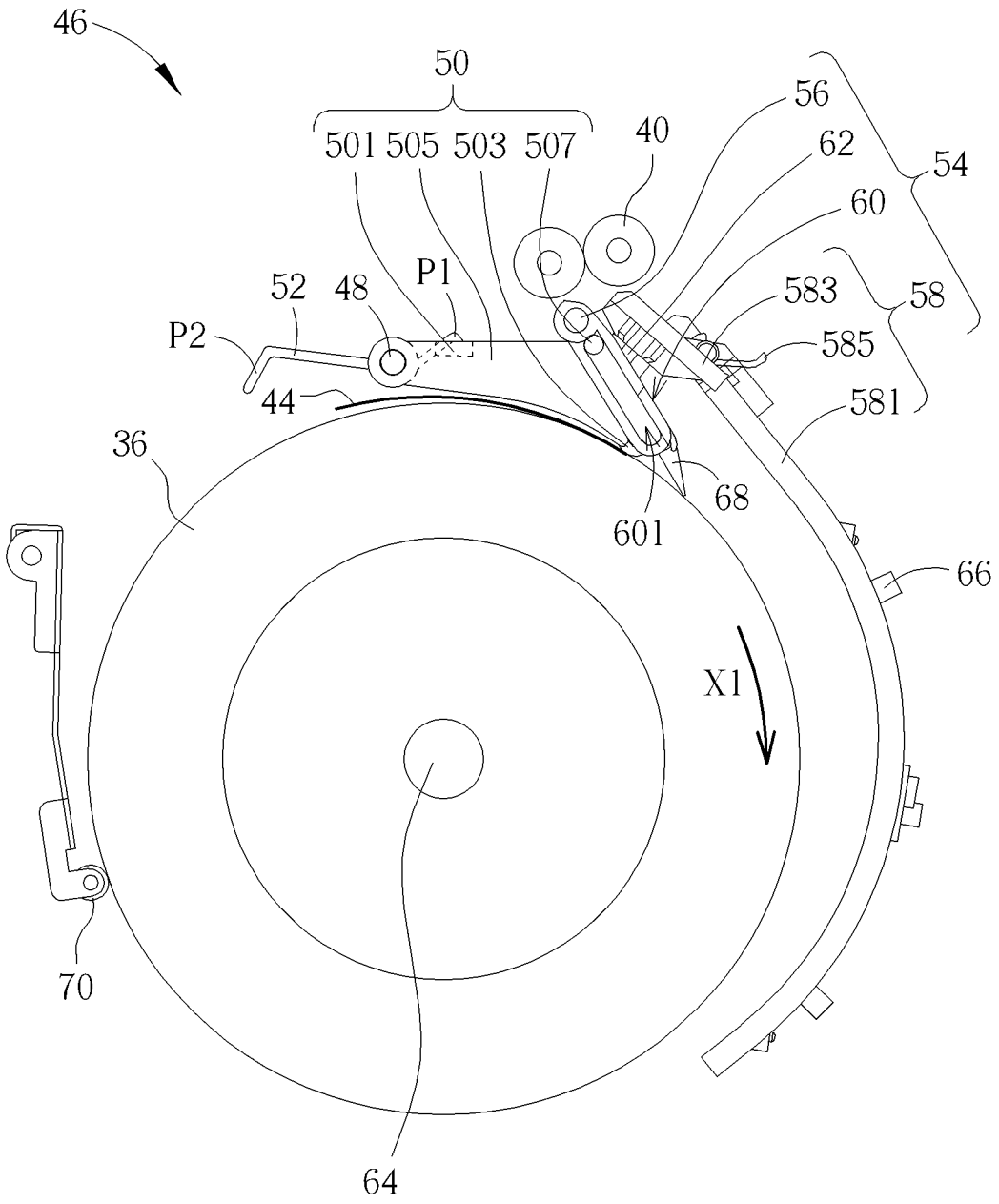
FIG. 3 is a diagram of an automatic paper feeding mechanism in a first status according to the preferred embodiment of the present invention.
Figure 4:
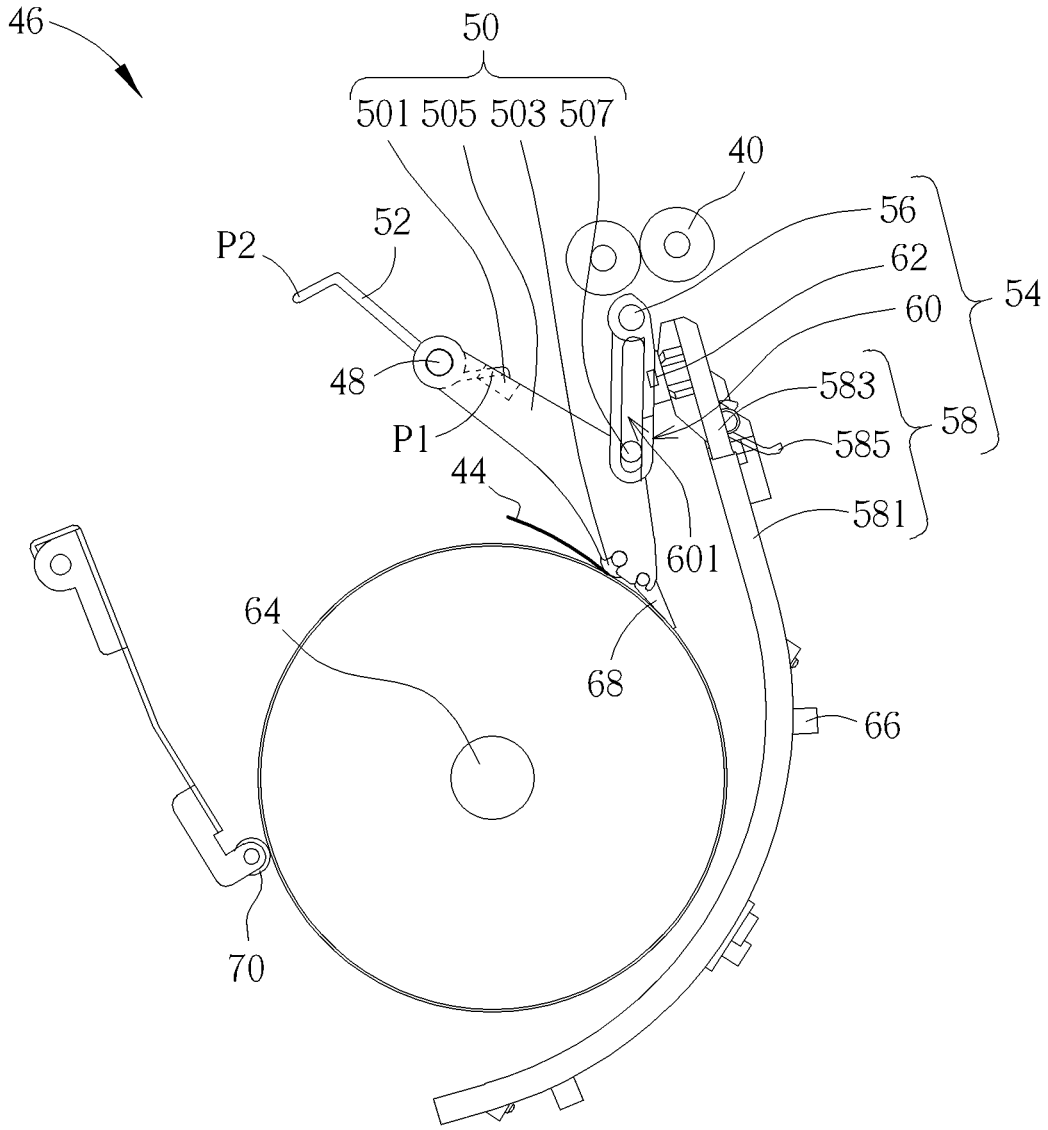
FIG. 4 is a diagram of the automatic paper feeding mechanism in a second status according to the preferred embodiment of the present invention.
Figure 5:
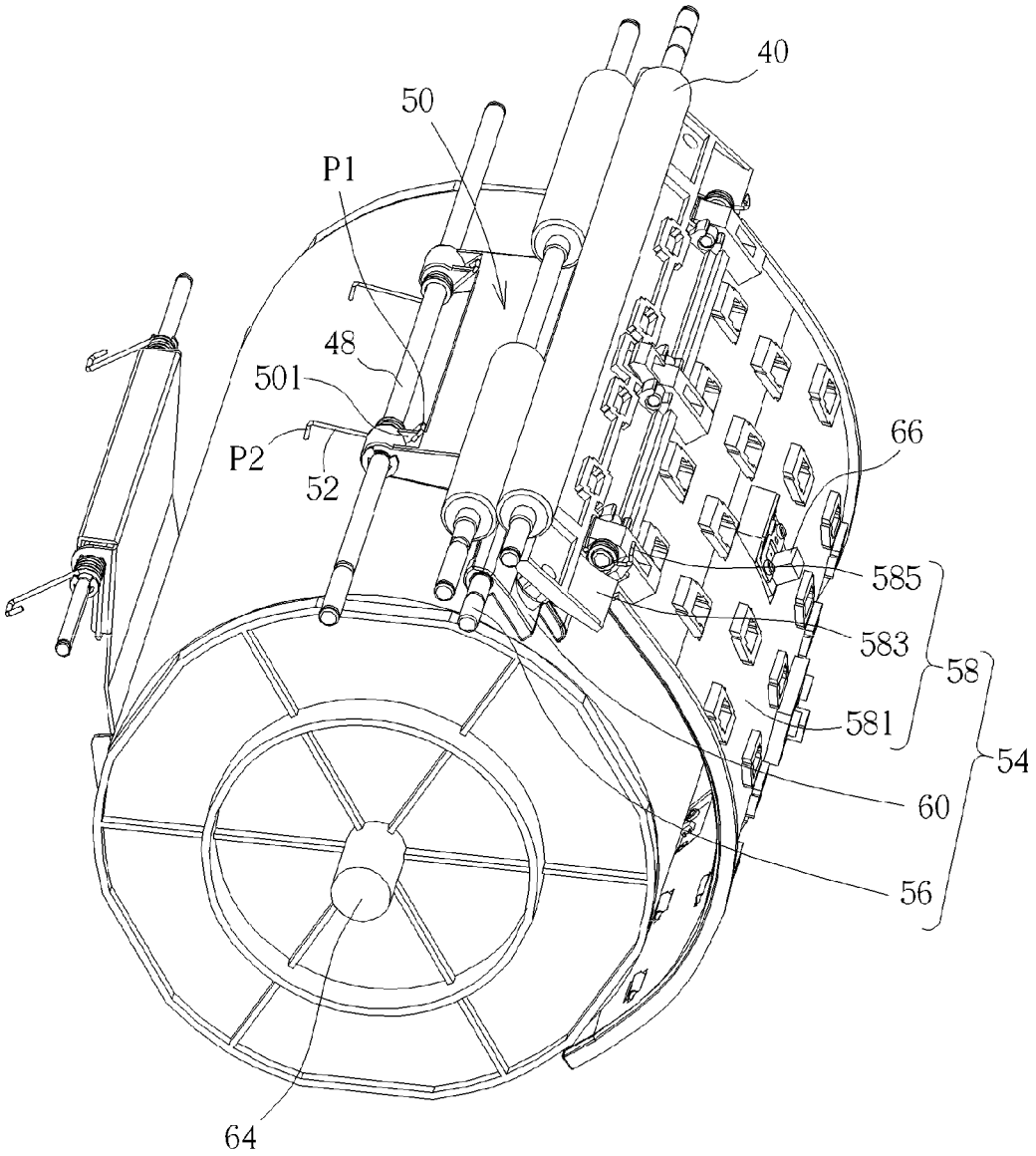
FIG. 5 is a diagram of the automatic paper feeding mechanism in another view according to the preferred embodiment of the present invention.

Please refer to FIG. 3 to FIG. 5. FIG. 3 is a diagram of the automatic paper feeding mechanism 46 in a first status according to the preferred embodiment of the present invention. FIG. 4 is a diagram of the automatic paper feeding mechanism 46 in a second status according to the preferred embodiment of the present invention. FIG. 5 is a diagram of the automatic paper feeding mechanism 46 in another view according to the preferred embodiment of the present invention. As shown in FIG. 3 to FIG. 5, the automatic paper feeding mechanism 46 includes a first pivotal member 48 and a paper pressing module 50. The paper pressing module 50 is pivoted to the first pivotal member 48. Practically, the first pivotal member 48 can be a shaft, and the shaft can be disposed on a fixing member of the thermal sublimation printer 30, such as being disposed on the casing 32 or the holding member 34. As for which one of the aforesaid designs is adopted, it depends on practical demands. Accordingly, the paper pressing module 50 can rotate relative to the automatic paper feeding mechanism 46 by the first pivotal member 48. Furthermore, the automatic paper feeding mechanism 46 further includes a driving member 52. The driving member 52 is used for driving the paper pressing module 50 to rotate relative to the first pivotal member 48, until the paper pressing module 50 presses the paper roll 36. In other words, the paper pressing module 50 is used for pressing the paper roll 36.

In this embodiment, the driving member 52 can be a torsion spring sheathing on the first pivotal member 48. A first end P1 of the driving member 52 abuts against a fixing structure 501 of the paper pressing module 50, as shown in FIG. 5. A second end P2 of the driving member 52 abuts against the fixing member of the thermal sublimation printer 30, such as abutting against the casing 32 or the holding member 34. As for which one of the aforesaid designs is adopted, it depends on practical demands. Since there is a predetermined torsion deformation between the first end P1 of the driving member 52 and the second end P2 of the driving member 52 when the paper pressing module 50 is located in a first position shown in FIG. 3, the driving member 52 can store a resilient potential energy when the paper pressing module 50 is located in the first position. Accordingly, the second end P2 of the driving member 52 can drive the fixing structure 501 of the paper pressing module 50, such that the paper pressing module 50 presses the paper roll 36 in the first position, so as to keep the paper roll 36 firmly shaped.

It should be noticed that the paper pressing module 50 of the thermal sublimation printer 30 of the present invention can includes a first idle roller 503 and a pressing member 505. An end of the pressing member 505 is pivoted to the first pivotal member 48, and the other end of the pressing member 505 is connected to the first idle roller 503. In this embodiment, the fixing structure 501 of the paper pressing module 50 is connected to the pressing member 505. As known above, when the paper pressing module 50 is located in the first position shown in FIG. 3, the second end P2 of the driving member 52 is capable of driving the fixing structure 501 on the pressing member 505 of the paper pressing module 50, such that the pressing member 505 rotates relative to the first pivotal member 48. Accordingly, the first idle roller 503 connected to the other end of the pressing member 505 abuts against the paper roll 36 and the printing medium 44, as shown in FIG. 3, for keeping the paper roll 36 firmly shaped as being in the first position.

When the paper pressing module 50 is moved from the first position shown in FIG. 3 to a second position shown in FIG. 4, the driving member 52 releases the resilient potential energy due to variation of the torsion deformation between the first end P1 and the second end P2. Accordingly, the driving member 52 can generate a resilient force, such that the second end P2 of the driving member 52 is capable of driving the fixing structure 501 on the pressing member 505 of the paper pressing module 50. As a result, the first idle roller 503 connected to the other end of the pressing member 505 presses the paper roll 36 in the second position for keeping the paper roll 36 firmly shaped in the second position.

As shown in FIG. 3 and FIG. 4, the automatic paper feeding mechanism 46 further includes a paper guiding module 54. The paper guiding module 54 is connected to the paper pressing module 50. In other words, the paper guiding module 54 can be driven by the paper pressing module 50. Furthermore, the paper guiding module 54 includes a second pivotal member 56, a first paper guiding member 58 and a second paper guiding member 60. The second paper guiding member 60 is pivoted to the second pivotal member 56 and connected to the paper pressing module 50 and the first paper guiding member 58. When the paper pressing module 50 is driven by the driving member 52 to move from the first position shown in FIG. 3 to the second position shown in FIG. 4, since the second paper guiding member 60 is connected to the paper pressing module 50 and the first paper guiding member 58 simultaneously, the second paper guiding member 60 can be driven by the paper pressing module 50 to drive the first paper guiding member 58 to move from a first guiding position shown in FIG. 3 to a second guiding position shown in FIG. 4.

In summary, when the paper pressing module 50 is driven by the driving member 52 to move from the first position to the second position, since the paper pressing module 50 is connected to the second paper guiding member 60 and the second paper guiding member 60 is connected to the first paper guiding member 58, the first paper guiding member 58 and the second paper guiding member 60 of the paper guiding module 54 can be driven by the paper pressing module 50 simultaneously. Accordingly, the paper guiding module 54 can move from the first guiding position shown in FIG. 3 to the second guiding position shown in FIG. 4. In such a manner, the automatic paper feeding mechanism 46 of the present invention can be used for adjusting a gap between the first paper guiding member 58 of the paper guiding module 54 and the paper roll 36. In other words, the automatic paper feeding mechanism 36 can be used for adjusting the gap between the paper guiding module 54 and the paper roll 36 according to the paper rolls 36 with different sizes or according to a thickness of the paper roll 36 in use, such that the printing medium 44 on the paper roll 36 is capable of being guided into the feeding roller 40 by the paper guiding module 54 more precisely. Accordingly, it can prevent the printing medium 44 from damages, such as skew, folding of the printing medium 44 and so on, when the feeding roller 40 moves the printing medium 44 to the thermal print head module 42.

Furthermore, the paper pressing module 50 of the automatic paper feeding mechanism 46 includes a sliding member 507, and a slot 601 is formed on the second paper guiding member 60. The sliding member 507 of the paper pressing module 50 is slidably installed inside the slot 601 on the second paper guiding member 60. When the paper pressing module 50 is driven by the driving member 52 to drive the second paper guiding member 60, the sliding member 507 of the paper pressing module 50 is capable of sliding along the slot 601 on the second paper guiding member 60. In such a manner, the second paper guiding member 60 is capable of sliding relative to the paper pressing module 50 when the second paper guiding member 60 is driven by the paper pressing module 50 to rotate relative to the second pivotal member 56. In addition, the first paper guiding member 58 of the paper guiding module 54 includes a main body 581, an adjusting member 583 and a recovery member 585. The adjusting member 583 is pivoted to the main body 581 and connected to the second paper guiding member 60. When the paper guiding module 54 is driven by the paper pressing module 50, the recovery member 585 drives the adjusting member 583 to rotate relative to the main body 581, such that the first paper guiding member 58 of the paper guiding module 54 is capable of moving from the first guiding position shown in FIG. 3 to the second guiding position shown in FIG. 4. In such a manner, the first paper guiding member 58 can cooperate with a proceeding path of the printing medium 44 inside the automatic paper feeding mechanism 46 more, such that the printing medium 44 is capable of being guided into the feeding roller 40 more smoothly during the aforesaid automatically paper feeding process. In this embodiment, the recovery member 585 can be a torsion spring.

Figure 6:
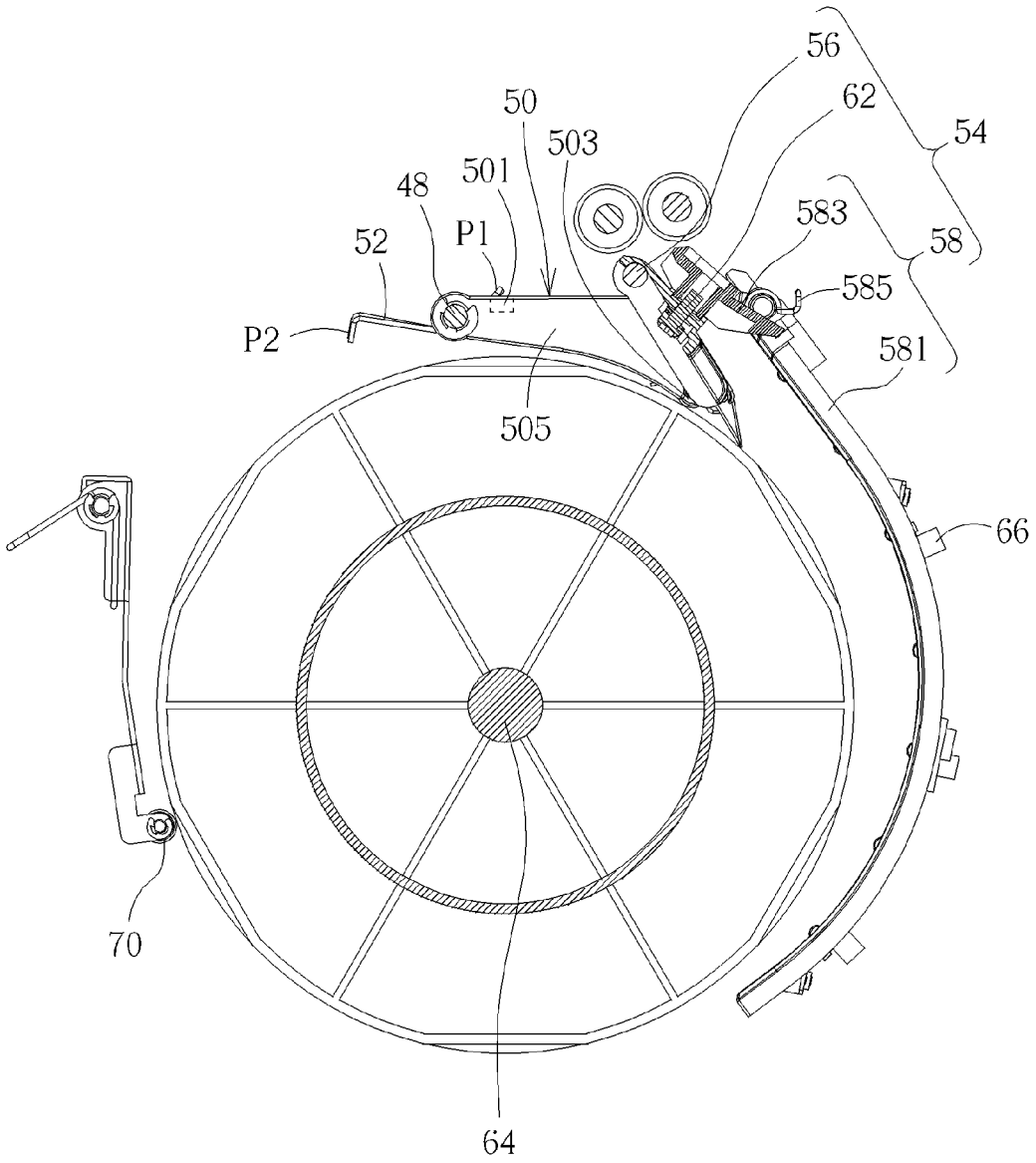
FIG. 6 is a partly sectional diagram of the automatic paper feeding mechanism according to the preferred embodiment of the present invention.

Please refer to FIG. 6. FIG. 6 is a partly sectional diagram of the automatic paper feeding mechanism 46 according to the preferred embodiment of the present invention. As shown in FIG. 6, the paper guiding module 54 further includes a connecting member 62 disposed on the second paper guiding member 60. Practically, the connecting member 62 can be a screw disposed through the second paper guiding member 60 and screwed on the adjusting member 583 of the first paper guiding member 58. In other words, the connecting member 62 is used for connecting the second paper guiding member 60 and the adjusting member 583. When the second paper guiding member 60 is driven by the paper pressing module 50, the second paper guiding member 60 can drive the first paper guiding member 58 to move between the first guiding position and the second guiding position by the connecting member 62. Furthermore, the automatic paper feeding mechanism 46 further includes a transmission shaft 64. The transmission shaft 64 is used for transmitting the torque generated by the conveying mechanism 38 of the thermal sublimation printer 30 to the paper roll 36, so as to drive the paper roll 36 to rotate. In addition, the automatic paper feeding mechanism 46 further includes a sensor 66. The sensor 66 is disposed on the main body 581 of the first paper guiding member 58 for sensing the printing medium 44 on the paper roll 36.

Figure 7:
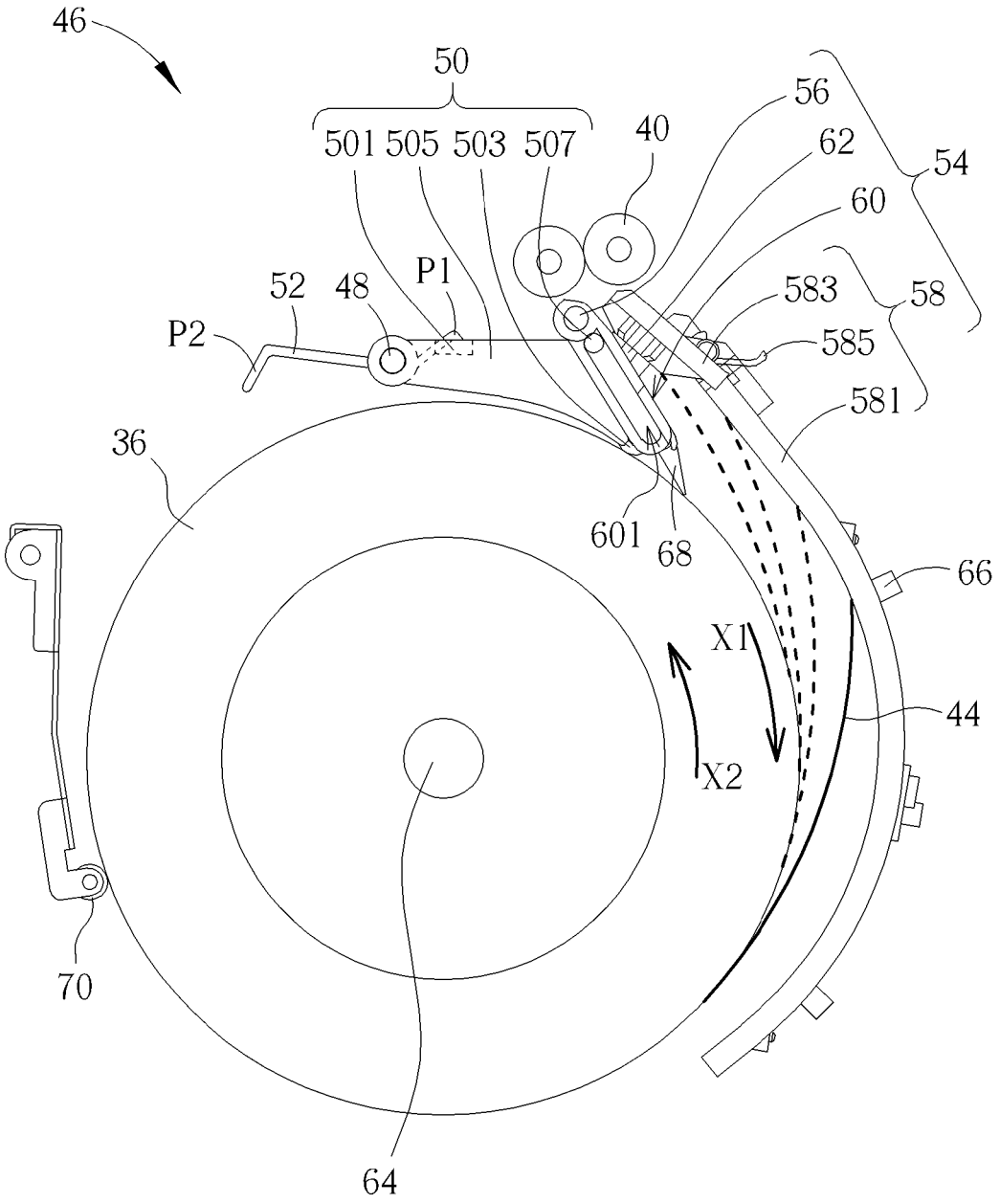
FIG. 7 is a diagram illustrating that a sensor senses a printing medium according to the preferred embodiment of the present invention.

More detailed description for principle of the automatic paper feeding mechanism 46 is provided as follows. Please refer to FIG. 3 and FIG. 7. FIG. 7 is a diagram illustrating that the sensor 66 senses the printing medium 44 according to the preferred embodiment of the present invention. As shown in FIG. 3 and FIG. 7, when the sensor 66 does not sense the printing medium 44, the conveying mechanism 38 of the automatic paper feeding mechanism 46 drives the transmission shaft 64 to rotate. Accordingly, the transmission shaft 64 drives the paper roll 36 to rotate in a first direction X1, so as to drive the printing medium 44 on the paper roll 36 to pass the first idle roller 503 of the paper pressing module 50, until a front edge of the printing medium 44 reaches the sensor 66, as shown in FIG. 7. When the sensor 66 senses the printing medium 44, the conveying mechanism 38 of the automatic paper feeding mechanism 46 drives the transmission shaft 64 to rotate, such that the transmission shaft 64 drives the paper roll 36 to rotate in a second direction X2 opposite to the first direction X1. In the meanwhile, the front edge of the printing medium 44 on the paper roll 36 is capable of moving along the first paper guiding member 58 of the paper guiding module 54, so as to guide the printing medium 44 into the feeding roller 40. In such a manner, the automatic paper feeding mechanism 46 of the present invention can guide the printing medium 44 on the paper roll 36 into the feeding roller 40 automatically.

It should be noticed that the automatic paper feeding mechanism 46 of the present invention can further include a guiding member 68. The guiding member 68 is pivoted to the second paper guiding member 60 and abuts against the paper roll 36. When the paper roll 36 is rotated in the second direction X2, the guiding member 68 is used for guiding the front edge of the printing medium 44 to enter the second paper guiding member 60 of the paper guiding module 54, so as to guide the printing medium 44 on the paper roll 36 into the feeding roller 40 automatically. In such a manner, the guiding member 68 can be used for preventing the front edge of the printing medium 44 from falling onto the paper roll 36 due to rigidity deficiency when the printing medium 44 is guided into the feeding roller 40. Accordingly, it can prevent an issue that the front edge of the printing medium 44 inserts into a gap between the first idle roller 503 and the paper roll 36 along a periphery of the paper roll 36 as well as prevent feeding failure and so on. In addition, the automatic paper feeding mechanism 46 further includes a second idle roller 70 for rollably pressing the paper roll 36. When the paper roll 36 is rotated in the second direction X2, the second idle roller 70 is used for pressing the paper roll 36 cooperatively with the first idle roller 503, so as to keep the paper roll 36 firmly shaped when the paper roll 36 is driven by the transmission shaft 64 to rotate in the second direction X2. As a result, it can prevent the paper roll 36 from being loosened as the paper roll 36 is rotated in the second direction X2 to avoid the feeding failure issue.

Compared to the prior art, the automatic paper feeding mechanism of the present invention utilizes the transmission mechanism, the transmission shaft and the sensor to automatically guide the printing medium on the paper roll into the feeding roller, such that the printing medium on the paper roll is installed into the feeding roller without manual operations. In such a manner, the automatic paper feeding mechanism of the present invention can prevent a surface of the printing medium from being polluted due to careless touch of users during the above-mentioned installation process, and further prevent issues of feeding failure generated by improper installation of the printing medium. In addition, by connection among the paper pressing module, the second paper guiding member and the first paper guiding member, the automatic paper feeding mechanism of the present invention can be used for adjusting the gap between the paper guiding module and the paper roll. For example, the automatic paper feeding mechanism can be used for adjusting the gap between the paper guiding module and the paper roll according to the paper rolls with different sizes or according to a thickness of the paper roll in use, such that the printing medium on the paper roll is capable of being guided into the feeding roller by the paper guiding module precisely. Accordingly, it can prevent the printing medium from damages, such as skew, folding of the printing medium and so on, when the feeding roller moves the printing medium to the thermal print head module.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An automatic paper feeding mechanism adapted to a paper roll, the automatic paper feeding mechanism comprising:

a first pivotal member;

a paper pressing module pivoted to the first pivotal member for pressing the paper roll;

a driving member for driving the paper pressing module, such that the paper pressing module respectively presses the paper roll in a first position and a second position; and a paper guiding module connected to the paper pressing module, the paper guiding module comprising:

a second pivotal member;

a first paper guiding member; and a second paper guiding member pivoted to the second pivotal member and connected to the paper pressing module and the first paper guiding member, the second paper guiding member being driven by the paper pressing module for moving the first paper guiding member from a first guiding position to a second guiding position when the paper pressing module is moved from the first position to the second position, so as to adjust the gap between the first paper guiding member and the paper roll.

2. The automatic paper feeding mechanism of claim 1, wherein the paper pressing module comprises a sliding member, a slot is formed on the second paper guiding member, the sliding member is slidably installed inside the slot, such that the second paper guiding member slides and rotates relative to the paper pressing module, and the first paper guiding member comprises:

a main body;

an adjustment member pivoted to the main body and connected to the second paper guiding member; and a recovery member for driving the adjustment member to rotate relative to the main body when the paper guiding module is driven by the paper pressing module.

3. The automatic paper feeding mechanism of claim 2, wherein the paper guiding module further comprises:

a connecting member disposed on the adjustment member for connecting the adjustment member with the second paper guiding member.

4. The automatic paper feeding mechanism of claim 2, wherein the recovery member is a torsion spring.

5. The automatic paper feeding mechanism of claim 2, wherein the paper pressing module comprises a first idle roller for rollably pressing a printing medium on the paper roll, and the automatic paper feeding mechanism further comprises:

a sensor disposed on the main body for sensing the printing medium on the paper roll; and a transmission shaft for driving the paper roll to rotate in a first direction when the sensor does not sense the printing medium, and further for driving the paper roll to rotate in a second direction opposite to the first direction when the sensor senses the printing medium.

6. The automatic paper feeding mechanism of claim 5, further comprising:

a guiding member pivoted to the second paper guiding member and abutting against the paper roll, the guiding member being for guiding the printing medium to enter the second paper guiding member when the paper roll rotates in the second direction; and a second idle roller for rollably pressing the paper roll, the second idle roller being for keeping the paper roll firmly shaped cooperatively with the first idle roller when the paper roll rotates in the second direction.

7. The automatic paper feeding mechanism of claim 1, wherein the driving member is a torsion spring.

8. A thermal sublimation printer, comprising:

a paper roll;

a feeding roller for moving a printing medium on the paper roll; and an automatic paper feeding mechanism for conveying the printing medium on the paper roll to the feeding roller, the automatic paper feeding mechanism comprising:

a first pivotal member;

a paper pressing module pivoted to the first pivotal member for pressing the paper roll;

a driving member for driving the paper pressing module, such that the paper pressing module respectively presses the paper roll in a first position and a second position; and a paper guiding module connected to the paper pressing module, the paper guiding module comprising:

a second pivotal member;

a first paper guiding member; and a second paper guiding member pivoted to the second pivotal member and connected to the paper pressing module and the first paper guiding member, the second paper guiding member being driven by the paper pressing module for moving the first paper guiding member from a first guiding position to a second guiding position when the paper pressing module is moved from the first position to the second position, so as to adjust the gap between the first paper guiding member and the paper roll.

9. The thermal sublimation printer of claim 8, wherein the paper pressing module comprises a sliding member, a slot is formed on the second paper guiding member, the sliding member is slidably installed inside the slot, such that the second paper guiding member slides and rotates relative to the paper pressing module, and the first paper guiding member comprises:

a main body;

an adjustment member pivoted to the main body and connected to the second paper guiding member; and a recovery member for driving the adjustment member to rotate relative to the main body when the paper guiding module is driven by the paper pressing module.

10. The thermal sublimation printer of claim 9, wherein the paper guiding module further comprises:

a connecting member disposed on the adjustment member for connecting the adjustment member with the second paper guiding member.

11. The thermal sublimation printer of claim 9, wherein the recovery member is a torsion spring.

12. The thermal sublimation printer of claim 9, wherein the paper pressing module comprises a first idle roller for rollably pressing a printing medium on the paper roll, and the automatic paper feeding mechanism further comprises:

a sensor disposed on the main body for sensing the printing medium on the paper roll; and a transmission shaft for driving the paper roll to rotate in a first direction when the sensor does not sense the printing medium, and further for driving the paper roll to rotate in a second direction opposite to the first direction when the sensor senses the printing medium.

13. The thermal sublimation printer of claim 12, wherein the automatic paper feeding mechanism further comprises:

a guiding member pivoted to the second paper guiding member and abutting against the paper roll, the guiding member being for guiding the printing medium to enter the second paper guiding member when the paper roll rotates in the second direction; and a second idle roller for rollably pressing the paper roll, the second idle roller being for keeping the paper roll firmly shaped cooperatively with the first idle roller when the paper roll rotates in the second direction.

14. The thermal sublimation printer of claim 12, further comprising a transmission mechanism for driving the transmission shaft to rotate.

15. The thermal sublimation printer of claim 8, wherein the driving member is a torsion spring.

* * * * *